US005681202A

United States Patent [19]

Sander

[11] Patent Number: 5,681,202

[45] Date of Patent: Oct. 28, 1997

[54] MAGNETIC COUPLING DEVICE OF A TOY VEHICLE

[75] Inventor: Börje Sander, Lönsboda, Sweden

[73] Assignee: Brio, AB, Osby, Sweden

[21] Appl. No.: 664,997

[22] Filed: Jun. 10, 1996

[30] Foreign Application Priority Data

Jan. 25, 1996 [SE] Sweden ..... 9600265

[51] Int. Cl.[6] ..... A63H 19/18

[52] U.S. Cl. ..... 446/138; 213/75 D

[58] Field of Search ..... 446/129, 132, 446/137, 138, 445, 446, 447, 467; 213/75 TC, 75 D

[56] References Cited

U.S. PATENT DOCUMENTS

| | | | |
|---|---|---|---|
| 2,847,798 | 8/1958 | Orel | 446/444 |
| 2,939,245 | 6/1960 | Orel | 446/138 |
| 3,330,066 | 7/1967 | Crawford | 446/138 |
| 3,840,127 | 10/1974 | Edwards et al. | 217/75 D |
| 3,850,310 | 11/1974 | Osthall | 213/75 TC |
| 3,942,648 | 3/1976 | Edwards et al. | 213/75 D |
| 4,195,742 | 4/1980 | Yumoto | 213/75 D |
| 5,048,704 | 9/1991 | Takahashi | 446/138 |
| 5,427,561 | 6/1995 | Eichhorn et al. | 446/138 |

*Primary Examiner*—Robert A. Hafer
*Assistant Examiner*—Jeffrey D. Carlson
*Attorney, Agent, or Firm*—Barnes, Kisselle, Raisch, Choate, Whittemore & Hulbert, P.C.

[57] ABSTRACT

A magnetic coupling device of a toy vehicle comprises a magnetic element and a fastening element, by means of which the magnetic element is attached to the vehicle. The device also comprises a dome-shaped coupling surface which is arranged on the magnetic element to be kept, by magnetic power, in engagement with a coupling surface of a coupling device of another toy vehicle. The fastening element is connected to the magnetic element and movably mounted on the toy vehicle such that the magnetic element with the coupling surface arranged thereon is freely pivotable at least about a horizontal axis extending transversely of the direction of motion of the vehicle.

1 Claim, 2 Drawing Sheets

MAGNETIC COUPLING DEVICE OF A TOY VEHICLE

BACKGROUND OF THE INVENTION

The present invention relates to a magnetic coupling device of a toy vehicle, comprising a magnetic element and a fastening element, by means of which the magnetic element is attached to the vehicle, the device further comprising a substantially dome-shaped coupling surface which is arranged on the magnetic element to be kept, by magnetic power, in engagement with a coupling surface of a coupling device of another toy vehicle.

In a known magnetic coupling device of this type, the magnetic element is a disk-shaped, circular magnet having a through center hole, and the fastening element is a metal nail with head and shank. The magnet is nailed to the toy vehicle by means of the nail, whose shank extends through the center hole of the magnet and whose head abuts against the magnet and urges this into engagement with the vehicle. In this manner, the magnet is fixed to the vehicle. The surface of the nail head facing away from the magnet is dome-shaped and forms the coupling surface of the magnetic coupling device.

When two toy vehicles, which are each provided with at least one such known magnetic coupling device, are coupled together by means of two coupling devices, whose magnets have opposite poles, the coupling surfaces of the two devices are kept, by magnetic power, in engagement with each other. By the coupling surfaces being dome-shaped, they constitute a coupling joint, the magnetic power being substantially constant independently of the angle between the two vehicles in the range of 0°–90° (0° meaning that the vehicles are aligned with one another). This applies independently of whether the vehicles are angled to one another in the horizontal plane or in the vertical plane.

When the coupled toy vehicles are driven on a hilly roadway, e.g. on rails of a toy railway, there arises, however, an inconvenience which will now be described with reference to FIG. 1.

FIG. 1 shows two carriages 1 and 2 in three different positions. The carriages 1 and 2 are included in a toy train, which is driven on a railway track 3 which is composed of wooden elements and which in the embodiment shown comprises a horizontal portion 3*a*, a succeeding, upwardly inclined ramp portion 3*b* and a succeeding, upper horizontal portion 3*c*. The direction of motion of the train is indicated by an arrow.

Each carriage 1, 2 has a front and a rear magnetic coupling device 4', 4" of the type described above. Each coupling device 4', 4" thus has a disk-shaped, circular magnet 5 and a fastening element in the form of a nail with a shank (not to be seen in FIG. 1) and a dome-shaped head 6, which forms the coupling surface of the device. The carriages 1 and 2 are coupled together by means of the rear coupling device 4" of the front carriage 1 and the front coupling device 4' of the rear carriage 2, the coupling devices having magnets with opposite poles.

When the carriages 1 and 2 are positioned on the horizontal track portion 3*a*, as shown to the right in FIG. 1, they are, like the coupling devices 4' and 4", horizontally aligned with each other. When the carriages 1 and 2 are driven forwards in the direction of the arrow, the front carriage 1 reaches the ramp portion 3*b* of the track 3 and is slightly angled relative to the rear carriage 2, as shown in the center of FIG. 1. Then the coupling surface formed of the nail head 6 in the rear coupling device 4" of the front carriage 1 slides a distance downwards along the coupling surface formed of the nail head 6 in the front coupling device 4' of the rear carriage 2 to the position shown in the center of FIG. 1. When the carriages 1 and 2 then reach the upper, horizontal track portion 3*c*, the coupling surfaces of the two devices 4' and 4" coupled together maintain their relative offset position, which means that the front portion of the rear carriage 2 is held in a raised position on the track portion 3*c*, as shown to the left in FIG. 1. The pair of front wheels 7 of the rear carriage 2 is held in a position raised from the track portion 3*c*. This is a considerable inconvenience when the front wheels 7 of the rear carriage 2 constitute driving wheels for driving the carriages 1 and 2, or when they constitute driving wheels for driving some sort of moving mechanism arranged in the rear carriage 2 and consequently must roll on the railway track 3 to be able to function.

SUMMARY OF THE INVENTION

The object of the present invention therefore is to provide a magnetic coupling device which prevents the above described raising of one pair of wheels and thus eliminates the above-mentioned inconvenience.

According to the invention, this object is achieved by a device which is of the type mentioned by way of introduction and in which the fastening element is connected to the magnetic element and movably mounted on the toy vehicle such that the magnetic element with the coupling surface arranged thereon is freely pivotable at least about a horizontal axis extending transversely of the direction of motion of the vehicle.

In a preferred embodiment, the fastening element has a head forming the substantially dome-shaped coupling surface, and a shank extending from the head and through the magnetic element into the toy vehicle, in which it is movably mounted.

Preferably the shank extends into the toy vehicle through a hole which is formed in a wall of the vehicle and whose dimensions are greater than those of the shank at least in the vertical direction, and the shank has, at its end inserted into the vehicle, an enlarged portion preventing the shank from being retracted from the hole.

BRIEF DESCRIPTION OF THE DRAWING

The invention will now be further described with reference to the accompanying drawings.

DESCRIPTION OF THE PREFERRED EMBODIMENT

Figure 2:
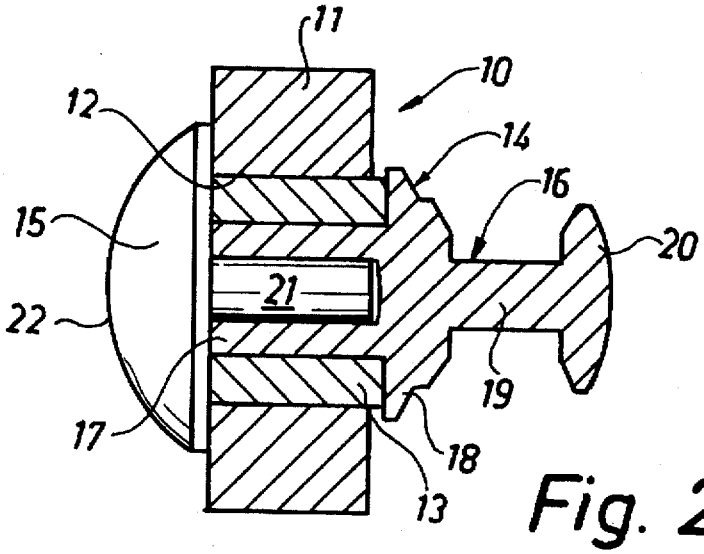
FIG. 2 is a longitudinal part-sectional view of a magnetic coupling device according to the present invention.

FIG. 2 shows a magnetic coupling device 10 according to the present invention. The device 10 has a disk-shaped, circular magnet 11 with a through center hole 12, in which a plastic sleeve 13 is inserted with a press fit. The axial length of the plastic sleeve 13 is slightly greater than the thickness of the magnet 11. The plastic sleeve 13 is inserted in the hole 12 of the magnet 11 such that its front end (to the left in FIG. 2) is located on the same level as the front of the magnet 11, while its rear end projects a distance at the back of the magnet 11.

The coupling device 10 further comprises a fastening element 14 consisting of two metal parts 15 and 16, of which one forms the head 15 of the fastening element 14 and the other forms the shank 16 thereof.

The shank 16 has at one end a bush 17, which is inserted with a press fit in the plastic sleeve 13. The bush 17 is rearwardly defined by a collar 18, which abuts against the rear end of the plastic sleeve 13. The front end of the bush 17 is located on the same level as the front end of the plastic sleeve 13 and, thus, on the same level as the front of the magnet 11. The shank 16 has a shank portion 19 positioned behind the collar 18 and having a smaller diameter, and an enlarged portion 20 at its rear end.

The head 15 has a backwardly projecting pin 21, which is inserted with a press fit into the bush 17 of the shank 16 so far that the planar back of the head 15 abuts against the front of the magnet 11 and, thus, also against the front end of the sleeve 13 and the bush 17. The front face of the head 15 forms a dome-shaped coupling surface 22 on the magnetic coupling device 10.

Figure 3:
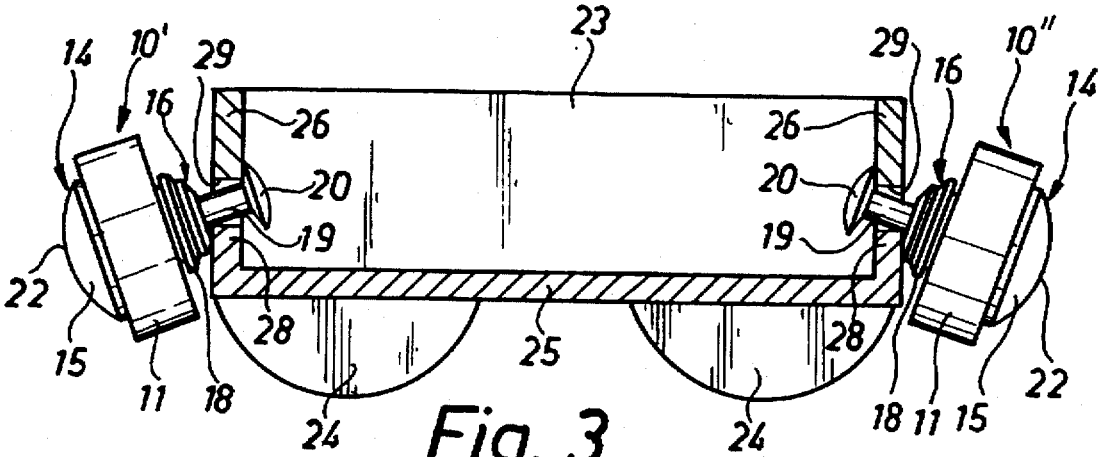
FIG. 3 illustrates a coupling device according to FIG. 2 mounted at each end of a toy vehicle, which is shown in longitudinal section.
Figure 4:
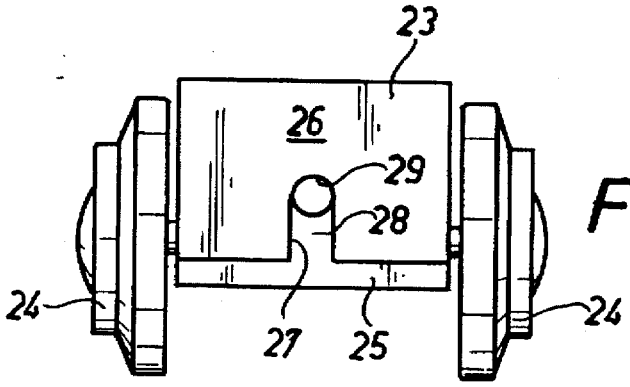
FIG. 4 is a front view of the vehicle, the coupling device being removed.

FIG. 3 shows a toy vehicle 23, which has four wheels 24 and consists of a carriage belonging to a toy train and having a magnetic coupling device both at its front end (to the left in FIG. 3) and at its rear end (to the right in FIG. 3). The front and rear coupling devices, which in FIG. 3 are designated 10' and 10", have magnets 11 with opposite poles. The carriage 23 has a bottom part 25 and two end walls 26. Each end wall 26 is formed with a slot 27 which extends a distance vertically upwards from the lower edge of the end wall (see FIG. 4). The bottom part 25 has at its front end as well as at its rear end an upwardly directly lug 28 which has the same width as the slot 27 of the associated end wall 26, but a shorter vertical extent than the slot. Each lug 28 defines together with the associated upper slot wall a circular hole 29, whose diameter is greater than the diameter of the shank portion 19 but considerably smaller than the diameter of the collar 18 and the enlarged portion 20. The thickness of the end walls 26 is smaller than the length of the shank portion 19.

Each coupling device 10', 10" is attached to the carriage 23 by means of the fastening element 14, whose shank 16 extends through the hole 29 in the associated end wall 26, the shank portion 19 being positioned in the hole 29 and the enlarged end portion 20 preventing the retraction of the shank 16 therefrom. As will be appreciated, the coupling devices 10' and 10" are arranged in the slot 27 of the associated end wall 26 before the bottom part 25 is mounted.

Since the diameter of the shank portion 19 is smaller than the diameter of the hole 29 and its length is greater than the thickness of the end wall 26, the magnetic coupling device 10' 10" is movably mounted on the carriage 23 and can pivot freely both horizontally and vertically.

Figure 1:
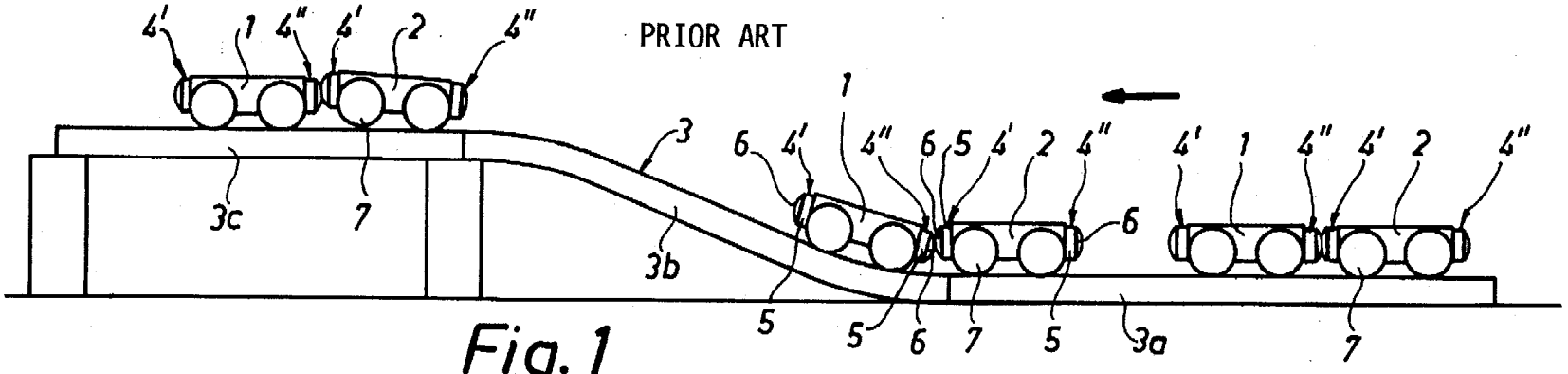
FIG. 1 illustrates the above-described inconvenience in a known magnetic coupling device.
Figure 5:
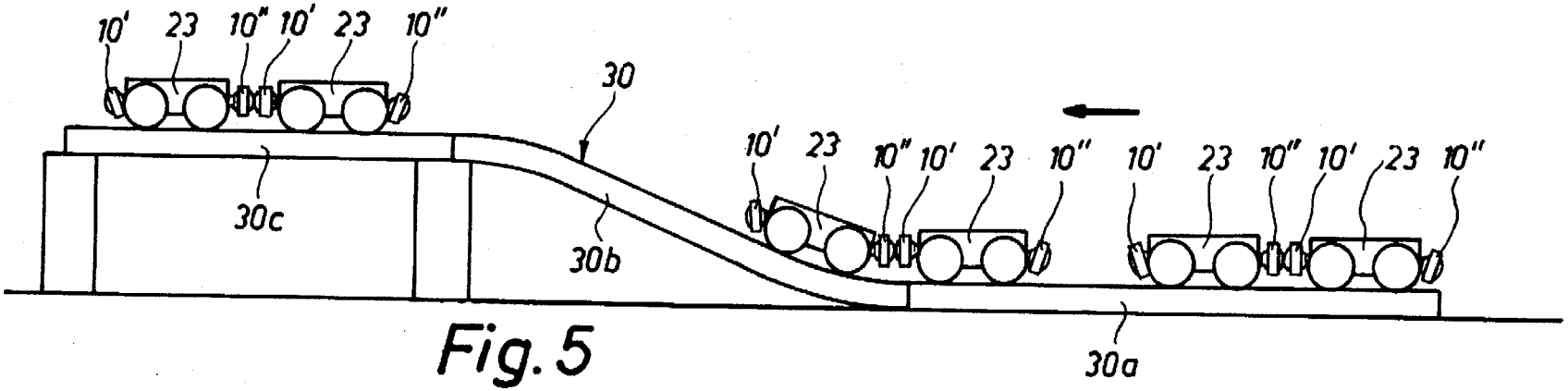
FIG. 5 corresponds to FIG. 1 and illustrates how the above-described inconvenience is eliminated by means of the coupling device according to the invention.

FIG. 5 illustrates two carriages 23 according to FIG. 3 in three different positions along a railway track 30 composed of wooden elements. The carriages 23 are included in a toy train, which is driven on the track 30 in the direction of the arrow. The track 30 has, like the track shown in FIG. 1, a horizontal portion **30*a*, a succeeding, upwardly inclined ramp portion 30*b* and a succeeding, upper horizontal portion 30*c*. The two carriages 23 are coupled together by means of the rear coupling device 10" of the front carriage and the front coupling device 10'** of the rear carriage.

When the carriages 23 are positioned on the horizontal track portion **30*a*, as shown to the right in FIG. 5, they are, like the coupling devices 10' and 10" which are coupled together, horizontally aligned with one another. When the carriages 23 are driven forwards in the direction of the arrow, the front carriage reaches the ramp portion 30*b* of the track 30 and is slightly angled relative to the rear carriage, as shown in the center of FIG. 5. During this angular positioning, no relative sliding displacement takes place between the coupling surfaces thanks to the pivotability of the coupling devices 10' and 10". First, the two coupling devices 10' and 10" maintain, as shown in the center of FIG. 5, their relative position in horizontal alignment with one another by the rear coupling device 10" of the front carriage being pivoted upwards relative to the carriage about an imaginary horizontal axis extending transversely of the direction of motion. When both carriages 23 are positioned on the ramp portion 30*b*, the coupling devices 10' and 10" are aligned with each other in parallel with the ramp portion 30*b*. When the front carriage reaches the upper horizontal track portion 30*c*, it is slightly angled relative to the rear carriage, the coupling devices 10' and 10" also being angled relative to each other without relative sliding between the coupling surfaces. When both carriages 23 have reached the upper horizontal track portion 30*c*, the two coupling devices 10' and 10" have, as shown to the left in FIG. 5**, again occupied their relative position in horizontal alignment with one another thanks to the pivotability of the coupling devices. As a result, the above described inconvenience of raised wheels has been eliminated.

What I claim and desire to secure by Letters Patent is:

1. A toy vehicle system comprising at least two toy vehicles and a magnetic coupling device on each vehicle adapted to be mounted on a track that includes a horizontal portion and an inclined portion, each said magnetic coupling device comprising a magnetic element and a fastening element, by means of which the magnetic element is attached to the vehicle, the device further comprising a substantially dome-shaped coupling surface which is arranged on the magnetic element to be kept, by magnetic power, in engagement with a coupling surface of the coupling device of the other toy vehicle, wherein the fastening element is connected to the magnetic element and movably mounted on the toy vehicle such that the magnetic element with the coupling surface arranged thereon is freely pivotable at least about a horizontal axis extending transversely of the direction of motion of the vehicle, each fastening element having a head forming the substantially dome-shaped coupling surface, and a shank extending from the head and through the magnetic element into its respective toy vehicle, in which it is movably mounted, said shank extending into the toy vehicle through a hole which is formed in a wall of the vehicle and whose dimensions are greater than those of the shank at least in the vertical direction, and the shank has, at its end inserted into the vehicle, an enlarged portion preventing the shank from being retracted from the hole, said dome-shaped magnetic coupling devices of said adjacent vehicles being in engagement and horizontally aligned with one another when the vehicles are on the horizontal portion of the track such that as the vehicles move onto the inclined portion of the track, the coupling devices pivot and remain aligned without relative sliding movement between the dome-shaped coupling devices, each coupling device comprising a circular magnet, a metal part defining said dome-shaped surface, a second metal part defining said fastening element extending through said magnet and a plastic sleeve interposed between said fastening element and said magnet.

* * * * *